US006826799B2

(12) United States Patent
Smith

(10) Patent No.: US 6,826,799 B2
(45) Date of Patent: Dec. 7, 2004

(54) SMITH AIR VAC

(76) Inventor: Donald A Smith, 2620 W. 1500 S., Vernal, UT (US) 84078

( * ) Notice: Subject to any disclaimer, the term of this patent is extended or adjusted under 35 U.S.C. 154(b) by 156 days.

(21) Appl. No.: 10/055,857

(22) Filed: Jan. 25, 2002

(65) Prior Publication Data

US 2003/0163890 A1 Sep. 4, 2003

(51) Int. Cl.[7] ..... A47L 5/16; A47L 5/18
(52) U.S. Cl. ..... 15/409; 15/353
(58) Field of Search ..... 15/353, 409

(56) References Cited

U.S. PATENT DOCUMENTS 2,863,525 A * 12/1958 Lucian ..... 55/334
3,971,096 A * 7/1976 Renholt ..... 15/326
4,915,245 A * 4/1990 Wouters et al. ..... 215/326
5,142,730 A * 9/1992 Braks et al. ..... 15/327.5
5,867,865 A * 2/1999 Obermuller et al. ..... 15/409
6,049,941 A * 4/2000 Vollenweider, II ..... 15/327.5
6,338,750 B1 * 1/2002 Lorini ..... 96/245

* cited by examiner

*Primary Examiner*—Terrence R. Till
(74) *Attorney, Agent, or Firm*—Mallinckrodt & Mallinckrodt; Robert R. Mallinckrodt

(57) ABSTRACT

This invention is a compressed air vaccum that attaches to an air hose and forces air down the handle. The air is then is forced through a venture, which causes vacuum to occur. It has a baffle deflection piece that stops the liquid and debris from coming up into the venture thus allowing the debris and liquid material to be dropped back into the canister of the vaccum. The handle, venture, and baffle are all one piece. The canister with the pick up tube for sucking is a separate piece and then they snap together. The canister is removable from the handle piece for easy clean up.

20 Claims, 1 Drawing Sheet

SMITH AIR VAC

BACKGROUND OF THE INVENTION

This invention is an air vacuum that hooks up to compressed air as found in automotive repair shops and garages. This vacuum is used for picking up spills such as occur in automotive repair shops. These being engine oil, transmission fluid, antifreeze, gas, water and any other liquids. This air vacuum also picks up dirt and debris besides liquid materials.

When working in a mechanic shop, employees always have messes to clean up or work in. This is very time consuming to have to stop and find old rags or kitty litter to throw on oil spills. This vacuum eliminates this problem all together by allowing fast and easy clean up. It doesn't take to much time to hook up the compressed air hose already found in shops and clean up these liquid and dirt messes before they get spread all over the shop work areas.

SUMMARY OF INVENTION

The present invention is a canister vacuum that attaches to compressed air. It works by blowing air down a 1" pipe, which is also the handle of the vacuum, and when the air goes through an air fitting on the end cap of the canister it then blows through a venturi opening that is separated by ¼" to cause vacuum inside the canister. Liquid and debris is then sucked up and because of the baffle deflection inside the canister the debris is deflected back into the bottom part of the canister. The vacuum bag on this particular vacuum is for safety for anything getting sucked into the airway. The vacuum bags are made of paper and are disposable.

It is a principle object of the invention to provide a vacuum the automotive shops in particular can use to easily clean up after spills that happen in these kinds of environments.

It is another object of this invention to allow the user easy disposal of debris and liquid vacuumed up by allowing the canister of the vacuum to snap off of the rest of the vacuum for easy clean up.

It is a general object of the invention to use compressed air to use a vacuum to clean up around shop and garage areas and for purposes described above, which is reasonably inexpensive, dependable and fully effective in accomplishing its intended purposes.

DETAILED DESCRIPTION OF INVENTION

Figure 2:
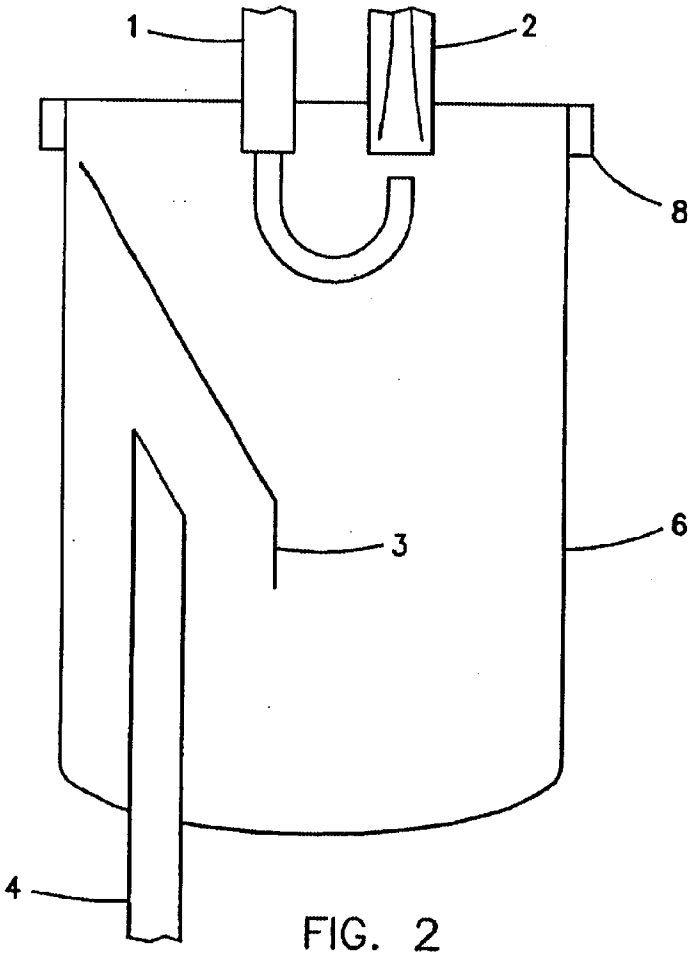
FIG. 2 is an enlarged fragmentary vertical section, similar to FIG. 1, showing the canister.
Figure 1:
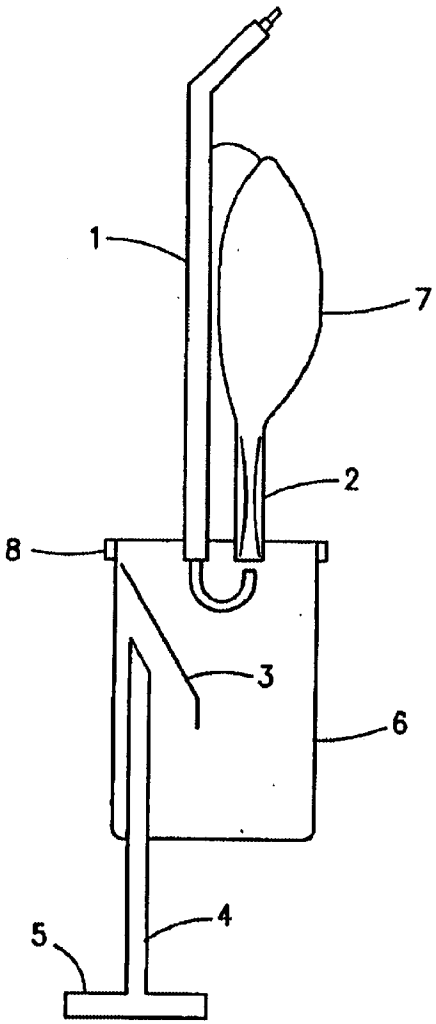
FIG. 1 is a vertical sectional view of the apparatus of the invention.

This device is an air-operated vacuum used to pick up liquids as well as dry materials in areas such as automotive shops and garages. Operation of this device is as follows. Air at 90 psi is attached to the handle 1, which serves as an airway to the venturi 2. As air is directed through the center of the venturi 2, vacuum is created inside the canister 6. Liquid and debris is sucked up the vacuum pipe 4, and debris then hits the baffle deflector 3, and then falls to the bottom of the canister 6. The vacuum bag 7 is used to catch some of the debris, which makes its way to the other side of the baffle deflector 3, and also to stop any fast moving debris. There are also attachments 5, that can be changed for vacuuming up different types of debris and liquids. There are clips 8, that you snap open to remove the canister 6, for easy disposal of debris vacuumed up.

1. Handle and air input
2. Venturi
3. Baffle Deflector
4. Pipe for vacuum intake
5. Vacuum Attachment
6. Canister
7. Vacuum Bag
8. Clip for holding the top end of the canister to the canister body

I claim:

1. A vacuum cleaning device powered by compressed air, comprising:

an elongate canister having a top end, a bottom end, and an internal chamber;

an elongate handle secured to the canister and extending above the top end of the canister and by which the canister can be held and manipulated;

a venturi and nozzle assembly in fluid flow communication with the top end of the internal chamber adapted to be connected to a source of compressed air whereby compressed air is directed from the nozzle through the venturi to create a vacuum in the internal chamber and having an outlet for air passing through the venturi;

a vacuum intake pipe secured to the canister and extending below the bottom end of the canister and into the chamber terminating in fluid flow communication with the chamber intermediate the top and bottom of the chamber; and a baffle deflector in the chamber arranged with respect to the termination of the vacuum intake pipe to deflect air and any debris and liquid entering the chamber from the vacuum pipe downwardly toward the bottom of the chamber.

2. A vacuum cleaning device according to claim 1, additionally including a filter around the outlet for air passing through the venturi.

3. A vacuum cleaning device according to claim 2, wherein the filter is a vacuum cleaner bag removably positioned around the outlet.

4. A vacuum cleaning device according to claim 1, wherein the elongate handle forms an airway for connecting a source of compressed air to the nozzle.

5. A vacuum cleaning device according to claim 4, wherein the handle has an end away from the canister and the handle is adapted to have a source of compressed air attached to the end of the handle away from the canister.

6. A vacuum cleaning device according to claim 5, wherein a compressed air passageway extends into the canister from the handle and forms a U which terminates as a nozzle directed toward the venturi.

7. A vacuum cleaning device according to claim 6, wherein the venturi extends through the top end of the canister.

8. A vacuum cleaning device according to claim 7, additionally including a filter around the outlet for air passing through the venturi.

9. A vacuum cleaning device according to claim 8, wherein the filter is a vacuum cleaner bag removably positioned around the outlet.

10. A vacuum cleaning device according to claim 7, wherein the canister is openable to remove debris from the chamber.

11. A vacuum cleaning device according to claim 10, wherein the canister has a canister body forming sides for the internal chamber, and wherein the top end of the canister is removable from the canister body.

12. A vacuum cleaning device according to claim 11, additionally including clips to secure the top end of the canister to the canister body.

13. A vacuum cleaning device according to claim 10, additionally including attachment ends for the vacuum intake pipe.

14. A vacuum cleaning device according to claim 13, wherein an attachment end for the vacuum intake pipe forms an end for sliding across a floor to vacuum up a liquid on the floor.

15. A vacuum cleaning device according to claim 1, wherein the canister is openable to remove debris from the chamber.

16. A vacuum cleaning device according to claim 15 wherein the canister has a canister body forming sides for the internal chamber, and wherein the top end of the canister is removable from the canister body.

17. A vacuum cleaning device according to claim 16, additionally including clips to secure the top end of the canister to the canister body.

18. A vacuum cleaning device according to claim 1, additionally including attachment ends for the vacuum intake pipe.

19. A vacuum cleaning device according to claim 18, wherein an attachment end for the vacuum intake pipe forms an end for sliding across a floor to vacuum up a liquid on the floor.

20. A vacuum cleaning device powered by compressed air, comprising:

an elongate canister having a top end, a bottom end, and an internal chamber;

an elongate handle extending from the top end of the canister by which the canister can be held and manipulated;

a venturi and nozzle assembly in fluid flow communication with the top end of the internal chamber adapted to be connected to a source of compressed air whereby compressed air is directed from the nozzle through the venturi to create a vacuum in the internal chamber and having an outlet for air passing through the venturi;

a vacuum intake pipe extending through the bottom end of the canister and into the chamber terminating in fluid flow communication with the chamber intermediate the top and bottom of the chamber; and a baffle deflector in the chamber arranged with respect to the termination of the vacuum intake pipe to deflect air and any debris and liquid entering the chamber from the vacuum pipe downwardly toward the bottom of the chamber.

* * * * *